US007276815B2

(12) United States Patent
Algrain et al.

(10) Patent No.: US 7,276,815 B2
(45) Date of Patent: Oct. 2, 2007

(54) POWER MANAGEMENT SYSTEM

(75) Inventors: Marcelo C. Algrain, Peoria, IL (US); Kris W. Johnson, Washington, IL (US); Sivaprasad Akasam, Peoria, IL (US); Brian D. Hoff, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 669 days.

(21) Appl. No.: 10/740,798

(22) Filed: Dec. 22, 2003

(65) Prior Publication Data

US 2004/0189098 A1 Sep. 30, 2004

Related U.S. Application Data

(60) Provisional application No. 60/458,460, filed on Mar. 28, 2003.

(51) Int. Cl.
*H02J 1/00* (2006.01)

(52) U.S. Cl. ..... 307/80; 307/43; 307/44; 307/52; 307/53; 307/65; 307/75; 307/76; 700/297

(58) Field of Classification Search ..... 700/22, 700/286; 307/10.1, 126, 43–86; 701/22
See application file for complete search history.

(56) References Cited

U.S. PATENT DOCUMENTS 5,608,271 A 3/1997 Saka et al.
5,633,537 A 5/1997 Kurata et al.
5,640,055 A * 6/1997 Sugiyama et al. ..... 307/10.1
5,696,695 A * 12/1997 Ehlers et al. ..... 700/286
5,717,310 A 2/1998 Sakai et al.
5,767,587 A 6/1998 Nishikiori
5,796,175 A 8/1998 Itoh et al.
5,834,854 A 11/1998 Williams
5,856,711 A * 1/1999 Kato et al. ..... 307/10.6
5,907,194 A * 5/1999 Schenk et al. ..... 307/10.1
5,977,652 A 11/1999 Frey et al.
6,049,141 A * 4/2000 Sieminski et al. ..... 307/44
6,111,768 A * 8/2000 Curtiss ..... 363/98
6,163,690 A 12/2000 Lilja
6,169,669 B1 * 1/2001 Choudhury ..... 363/37
6,182,171 B1 1/2001 Akatsuka et al.
6,226,305 B1 5/2001 McLoughlin et al.
6,232,674 B1 5/2001 Frey et al.
6,265,853 B1 * 7/2001 Takagi et al. ..... 323/220
6,301,528 B1 10/2001 Bertram et al.
6,420,797 B1 7/2002 Steele et al.
6,427,107 B1 * 7/2002 Chiu et al. ..... 701/50
6,449,537 B1 * 9/2002 Phillips et al. ..... 701/22

(Continued)

*Primary Examiner*—Thomas Black
*Assistant Examiner*—Wae Lenny Louie
(74) *Attorney, Agent, or Firm*—Finnegan, Henderson, Farabow, Garrett & Dunner

(57) ABSTRACT

A method of managing power resources for an electrical system of a vehicle may include identifying enabled power sources from among a plurality of power sources in electrical communication with the electrical system and calculating a threshold power value for the enabled power sources. A total power load placed on the electrical system by one or more power consumers may be measured. If the total power load exceeds the threshold power value, then a determination may be made as to whether one or more additional power sources is available from among the plurality of power sources. At least one of the one or more additional power sources may be enabled, if available.

20 Claims, 3 Drawing Sheets

U.S. PATENT DOCUMENTS 6,465,908 B1 * 10/2002 Karuppana et al. ..... 307/31
6,494,277 B1 * 12/2002 Boggs et al. ..... 180/65.2
6,580,180 B2 * 6/2003 Tamai et al. ..... 307/10.1
6,611,068 B2 * 8/2003 Cratty ..... 307/64
6,615,118 B2 * 9/2003 Kumar ..... 701/19
6,633,802 B2 10/2003 Sodoski et al.
6,642,633 B1 * 11/2003 Yang ..... 307/147
6,687,580 B2 * 2/2004 Suzuki et al. ..... 701/22
6,700,386 B2 * 3/2004 Egami ..... 324/503
6,759,764 B1 * 7/2004 Keller et al. ..... 307/44
6,803,677 B2 * 10/2004 Algrain et al. ..... 307/44
6,902,837 B2 * 6/2005 McCluskey et al. ..... 429/9
6,985,799 B2 * 1/2006 Zalesski et al. ..... 700/286
7,120,520 B2 * 10/2006 Seto et al. ..... 700/297
7,176,585 B2 * 2/2007 Fehr ..... 307/9.1
2002/0108065 A1 8/2002 Mares
2002/0130554 A1 * 9/2002 Banas et al. ..... 307/10.3
2002/0177929 A1 * 11/2002 Kumar ..... 701/19
2003/0062773 A1 * 4/2003 Richter et al. ..... 307/10.1
2003/0085689 A1 * 5/2003 Berneis et al. ..... 320/135
2003/0095367 A1 5/2003 Mares et al.
2004/0044448 A1 * 3/2004 Ramaswamy et al. ..... 701/22
2005/0179324 A1 * 8/2005 Petricek ..... 307/44
2006/0214512 A1 * 9/2006 Iwata ..... 307/44
2006/0220462 A1 * 10/2006 O'Leary ..... 307/44

* cited by examiner

POWER MANAGEMENT SYSTEM

CLAIM FOR PRIORITY

This application claims the benefit of U.S. Provisional Application No. 60/458,460, filed Mar. 28, 2003, which is incorporated herein by reference.

U.S. GOVERNMENT RIGHTS

This invention was made with government support under the terms of Contract No. DE-FC04-2000AL67017 awarded by the Department of Energy. The government may have certain rights in this invention.

TECHNICAL FIELD

This invention relates generally to a power management system and, more particularly, to a power management system used in a vehicle having one or more electrically powered accessories.

BACKGROUND

In response to fuel efficiency concerns and desired performance characteristics, an emphasis has been placed on using electrical power to operate various components associated with a vehicle. Hybrid vehicles have been developed, for example, that rely on a combination of electric energy and energy produced by a traditional combustion engine to power certain electrical accessories and traction devices. One problem faced by hybrid vehicles results from the different power level requirements of the various electrically powered elements. Certain applications may require two or more power sources having different power level outputs to meet the needs of the electrical elements. Further, electrical buses for segregating the different power levels and for supplying power to the electrical elements may also be necessary.

Electrical systems including, for example, a low voltage power source combined with a higher voltage power source have been proposed to address these issues. For example, U.S. Pat. No. 6,580,180 to Tamai et al. ("the '180 patent"). discloses an electrical system that includes both a low voltage battery and a higher voltage battery. The low voltage battery may be used to operate low power devices, while the higher voltage battery may be used to operate higher power devices. The electrical system of the '180 patent also includes low and high voltage buses for carrying the different power levels to the various devices.

While the electrical system of the '180 patent may meet the power requirement needs of certain vehicles, this electrical system may be problematic and may not offer a desired level of operational flexibility. For example, the voltage level of the higher voltage battery (and associated bus) may be insufficient for operating certain high load devices such as HVAC units, electric pumps, air compressors, and other devices that may be found on trucks, work machines, and other types of vehicles. Further, the electrical system of the '180 patent is not configured for receiving power from outside sources. As a result, in order to operate the various devices for significant time periods without depleting the batteries, the engine must be running. Also, the buses of the electrical system of the '180 patent include no partitioning. Thus, there is no capability for energizing only a portion of a particular bus. Rather, each bus will be either fully energized or fully de-energized energized. Further still, the electrical system of the '180 patent may be unsuitable for implementation of a flexible power management system allowing centralized control of power sources and power consuming devices.

The present invention is directed to overcoming one or more of the problems or disadvantages existing with the electrical system architectures of the prior art.

SUMMARY OF THE INVENTION

One aspect of the disclosure includes a method of managing power resources for an electrical system of a vehicle. The method may include identifying enabled power sources from among a plurality of power sources in electrical communication with the electrical system and calculating a threshold power value for the enabled power sources. A total power load placed on the electrical system by one or more power consumers may be measured. If the total power load exceeds the threshold power value, then a determination may be made as to whether one or more additional power sources is available from among the plurality of power sources. At least one of the one or more additional power sources may be enabled, if available.

Another aspect of the disclosure includes a controller for an electrical system of a vehicle. The controller may include at least one processor and a storage device including one or more instructions for performing the steps of: identifying enabled power sources from among a plurality of power sources in electrical communication with the electrical system; calculating a threshold power value for the enabled power sources; and measuring a total power load placed on the electrical system by one or more power consumers. The. one or more instructions may further be configured to perform at least one of the steps of decreasing a power load value for at least one of the one or more power consumers if the total power load exceeds the threshold power value, and enabling at least one additional power source from among the plurality of power sources.

DETAILED DESCRIPTION

Figure 1:
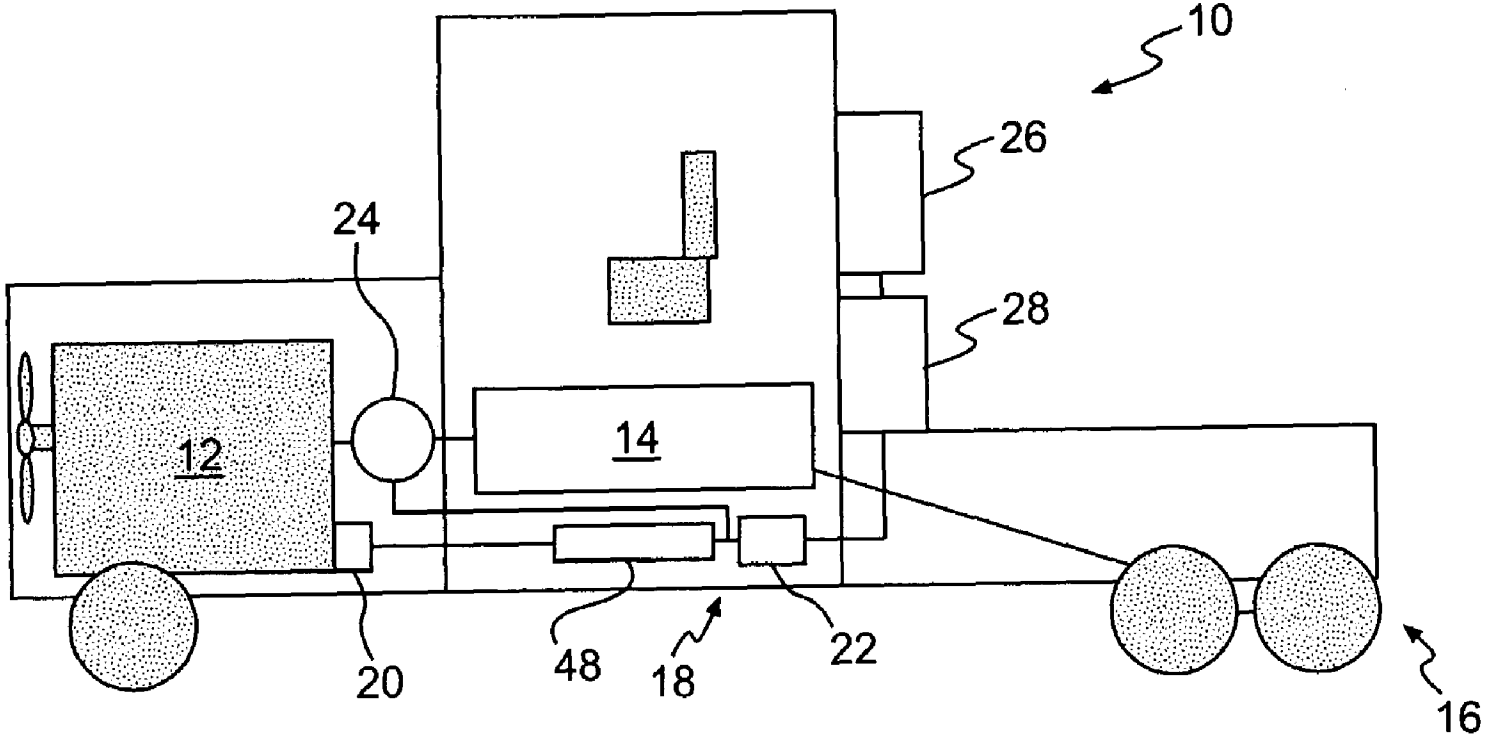
FIG. 1 provides a diagrammatic illustration of a vehicle including an electrical system according to an exemplary embodiment of the present invention.

FIG. 1 illustrates an exemplary embodiment of a vehicle 10, which includes an engine 12, a transmission 14, and a traction device 16. While vehicle 10 is shown in FIG. 1 as a truck, vehicle 10 may be an automobile, recreational vehicle, work machine, or any other type of vehicle known in the art. Vehicle 10 may include an electrical system 18 configured to supply electrical energy to various components on the vehicle. In one embodiment, electrical system 18 may include a low voltage battery 20, a high voltage battery 22, and a starter generator 24. Electrical system 18 may also include various power consuming devices including, for example, a heating, ventilation, and air conditioning (HVAC) unit 26. Electrical system 18 may also include various power sources in addition to low voltage battery 20, high voltage battery 22, and starter generator 24. For example, electrical system 18 may include an auxiliary power unit (APU) 28, which may include a generator powered by a diesel engine, a gasoline engine, or any other type of power supplying device.

Figure 2:
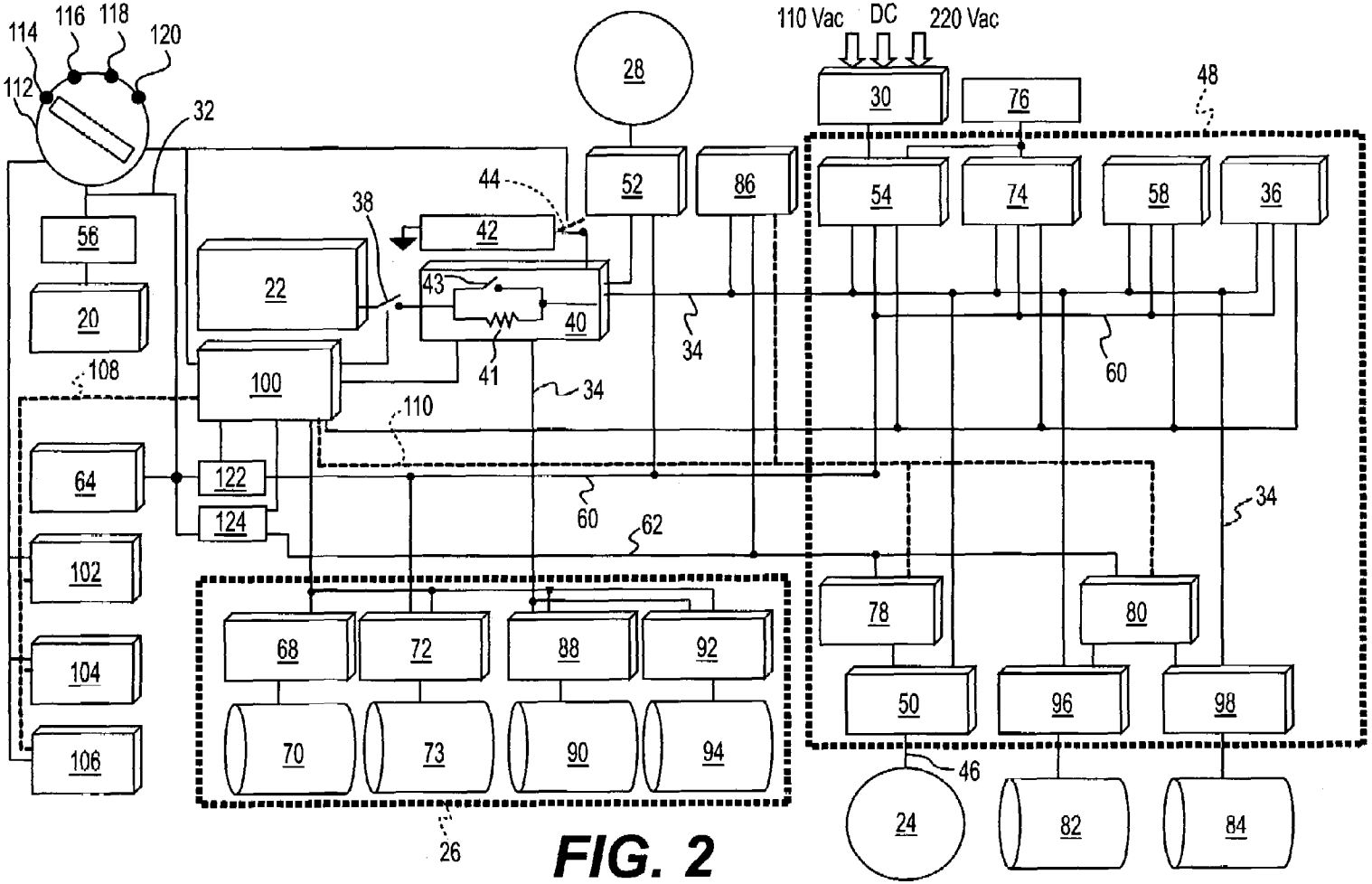
FIG. 2 provides a block-level schematic of an electrical system architecture according to an exemplary embodiment of the present invention.

FIG. 2 provides a block level diagram of an exemplary embodiment of electrical system 18. As illustrated, electrical system 18 includes several sources of power that supply electrical energy to various parts of electrical system 18. For example, electrical system 18 may include low voltage battery 20, high voltage battery 22, starter generator 24, and APU 28, as described above. Electrical system 18 may also include one or more additional power sources. In one embodiment, electrical system 18 also includes a shore power interface 30 that is configured to receive electrical power from a source external to vehicle 10.

Low voltage battery 20 may be configured to provide any desired voltage level. In one embodiment, however, low voltage battery 20 may be a 12 Vdc battery. Similarly, high voltage battery 22 may be configured to provide any desired voltage level. For example, high voltage battery 22 may generate at least about 50 Vdc. In one exemplary embodiment, high voltage battery 22 may include a 288 Vdc battery. It should be noted that the charging voltages for low voltage battery 20 and high voltage battery 22 will be different than the voltage capacity of the respective batteries. In the exemplary embodiments described, low voltage battery 20 may have a charging voltage of approximately 14V, and high voltage battery 22 may have a charging voltage of approximately 340V.

Starter generator 24 may be operatively coupled to engine 12 and may be located within the flywheel housing (not shown) of engine 12. When engine 12 is running, starter generator 24 may operate in a generating mode to provide a source of power to electrical system 18. Alternatively, starter generator 24 may be used in a starting mode to crank engine 12.

APU 28 may be located on vehicle 10 and may provide power to electrical system 18 when engine 12 is either running or not running. In one embodiment, APU 28 includes a two-cylinder, 0.5 liter, diesel engine having a power rating of approximately 14 hp. It will be appreciated, however, that any size engine or power source may be used for APU 28 depending on the requirements of a particular application.

Shore power interface 30 may include one or more power receptacles for connecting to sources of power including utility power (e.g., electric grid), an external generator, an external battery, power connections supplied by third parties (e.g., campgrounds, truck stops, rest areas, etc.), or any other sources of external power. In one embodiment, shore power interface 30 includes a receptacle configured to receive 110 Vac power and another receptacle configured to receive 220 Vac power. Shore power interface 30 may also include a receptacle for receiving a DC voltage provided by, for example, a battery or other DC voltage source (not shown) located external to vehicle 10.

Electrical system 18 may include one or more electrical buses to transport electrical energy from any of low voltage battery 20, high voltage battery 22, starter generator 24, APU 28, and shore power interface 30 to one or more consumers of electrical power. In one embodiment, electrical system 18 includes a low voltage bus 32 and a high voltage bus 34.

Each of low voltage battery 20, high voltage battery 22, starter generator 24, APU 28, and shore power interface 30 may be used to supply a voltage to high voltage bus 34. For example, an up converter 36 may be connected between low voltage bus 32, which receives the voltage supplied by low voltage battery 20, and high voltage bus 34. Through up converter 36, the voltage of low voltage battery 20 may be increased to a level compatible with high voltage bus 34. In this way, low voltage battery 20 may be used to charge high voltage battery 22 and/or to operate power consumers connected to high voltage bus 34 for at least a certain amount of time.

High voltage battery 22 may be directly coupled to high voltage bus 34 through, for example, a switch 38. Alternatively, as shown in FIG. 2, high voltage battery 22 and switch 38 may be connected to an electrical power distribution device 40, which connects to high voltage bus 34. Through power distribution device 40, the voltage of high voltage battery 22 may be supplied to high voltage bus 34. For example, power distribution device 40 may include a switch 43 disposed in parallel with a resistor 41. High voltage battery 22 may energize high voltage bus 34 along either the path including switch 43 (i.e., when switch 43 is closed) or along the path including resistor 41 (i.e., when switch 43 is open).

Starter generator 24 may also be configured to supply power to high voltage bus 34. For example, electrical power generated by starter generator 24 may be carried by line 46 to an electronics module 48 that, in one embodiment, houses power electronics 50 associated with starter generator 24. Power electronics 50 may convert the electrical energy supplied by starter generator 24 to a DC voltage level compatible with high voltage bus 34.

Similarly, APU 28 may be configured to supply power to high voltage bus 34. For example, electrical power generated by APU 28 may be carried to APU power electronics 52. APU power electronics 52 may convert the electrical energy supplied by APU 28 to a DC voltage level compatible with high voltage bus 34.

Shore power interface 30 may provide yet another source for energizing high voltage bus 34. For example, shore power interface 30 may receive an externally applied DC voltage level, 110 Vac power, and/or 220 Vac power and transfer this power to a shore power converter 54. Shore power converter 54 may include a rectifier bridge to convert the AC shore power to a DC voltage level compatible with high voltage bus 34. Shore power converter 54 may also be configured to pass through the externally supplied DC voltage level directly to high voltage bus 34. Further, shore power converter 54 may include one or more up converting devices configured to boost the rectified shore power and/or the externally supplied DC voltage level to a DC level compatible with high voltage bus 34.

Like high voltage bus 34, low voltage bus 32 may receive power from one or more power sources. For example, low voltage battery 20 may be connected directly to low voltage bus 32. Alternatively, low voltage battery 20 may be connected to low voltage bus 32 through one or more devices including, for example, a disconnect switch 56. Further, any of high voltage battery 22, APU 28, starter generator 24, and shore power interface 30 may be configured to provide power to low voltage bus 32 via, for example, high voltage bus 34 and a down converter 58, which may be provided for converting a voltage level applied to high voltage bus 34 down to a voltage level compatible with low voltage bus 32.

In one exemplary embodiment, low voltage bus 32 may be partitioned into one or more sub-buses. As shown in FIG. 2, low voltage bus 32 is partitioned into an accessory bus 60 and an ignition bus 62. Both accessory bus 60 and ignition bus 62 may carry the same voltage level (e.g., 12 Vdc).

Partitioning low voltage bus 32 may allow certain portions of low voltage bus 32 to be energized without energizing all of low voltage bus 32.

In addition to a plurality of power sources, electrical system 18 may also include one or more power consumers. These power consumers may be organized and connected to either high voltage bus 34 or low voltage bus 32 depending on the particular power requirements of the consumer.

Low voltage bus 32 may supply electrical power to various types of devices. For example, low voltage bus 32 may power devices such as lights, displays, wipers, radios, and various other low power cab/vehicle loads 64 associated with vehicle 10.

Low voltage bus 32 may also supply power to various other devices. For example, as shown in FIG. 2, accessory bus 60 may provide power to power electronics 68 associated with an HVAC blower 70, to HVAC blower 70, HVAC condenser power electronics 72, an HVAC condenser 73, APU electronics 52, shore power converter 54, down converter 58, up converter 36, and to a single phase inverter 74 associated with isolated power outlets 76 located on vehicle 10. The power supplied by accessory bus 60 acts to place one or more of these devices in an active mode in which the devices may be enabled to control or activate other devices. The devices connected to accessory bus 60 may be energized when electrical system 18 is placed in an accessory mode, discussed below.

Ignition bus 62 may also supply power to various devices. In one embodiment, as shown in FIG. 2, ignition bus 62 supplies power to a starter generator controller 78, which controls the operation of starter generator 24. Ignition bus 62 may also supply power to a combined water pump and oil pump electronic control unit 80, which generates signals for operating an electric oil pump 82 and an electric water pump 84. It should be noted that instead of combined water pump and oil pump electronic control unit 80, individual control units could be used for each of the water pump and oil pump. Further, ignition bus 62 may also supply power to an air compressor module 86. The devices connected to ignition bus 62 may be energized when electrical system 18 is placed in an ignition, or run, mode. In one exemplary embodiment, the devices connected to ignition bus 62 may remain dormant, however, when electrical system 18 is placed in an accessory mode.

High voltage bus 34 communicates with various electrical accessories on vehicle 10. In certain embodiments, the higher voltage carried by high voltage bus 34 may be used to directly operate the electrical accessories. For example, high voltage bus 34 may supply power to heater electronics 88, a heater element 90, a compressor converter 92, and an HVAC compressor 94 for HVAC unit 26. Further, high voltage bus 34 may supply power for operating starter generator 24 in starter mode. High voltage bus 34 may also be connected to an oil pump converter 96 and a water pump converter 98 for driving the electric oil pump 82 and the electric water pump 84, respectively. Air compressor module 86, which may supply pressurized air for braking and/or ride control, may be connected to high voltage bus 34. Power outlets 76 may also be connected to high voltage bus 34 through, for example, single phase inverter 74. These power outlets may be used to supply power to various electrical devices including, for example, a refrigerator, personal electronic devices, electric cooking devices, cleaning accessories, and various other electrical devices that may be used in conjunction with vehicle 10.

Electrical system 18 may include a controller 100 configured to control various components of electrical system 18. For example, controller 100 may supply signals to APU electronics 52, shore power converter 54, single phase inverter 74, down converter 58, up converter 36, and/or HVAC unit 26 to enable or disable any of these devices or associated devices (e.g., APU 28, shore power interface 30, power outlets 76, etc.). Controller 100 can also connect or disconnect high voltage battery 22 from high voltage bus 34 by controlling, for example, switch 38.

Controller 100 may also be configured to control the operational characteristics of various components of electrical system 18. Controller 100 may communicate with an engine ECU 102, a power train ECU 104, and other ECUs and sensors 106 to collect information relating to the current operational characteristics of engine 12, transmission 14, and other desired components of vehicle 10. This information may be transferred to controller 100 over various types of data links including, for example, a CAN data link 108. Controller may also communicate with starter generator control electronics 78 and a combined water and oil pump ECU over a CAN data link 110 to collect information regarding the operation of oil pump 82 and water pump 84. In response to all of the information collected, controller 100 may determine whether the operation of any of air compressor module 86, starter generator 24, oil pump 82, and/or water pump 84 needs to be adjusted. If adjustments are necessary, controller 100 may pass appropriate signals over CAN data link 110 to request a change in operation of one or more of the controlled components.

Controller 100 may also control the operation of components in electrical system 18 based on a mode selector 112. Mode selector 112 may correspond, for example, to a key switch of vehicle 10 and may have one or more positions each indicative of an operating mode of vehicle 10 and/or electrical system 18. In one embodiment, mode selector 112 includes an OFF position 114, an ACCESSORY position 116, an ON/RUN position 118, and a START position 120. OFF position 112 may correspond to a condition where engine 12 is not running and none of high voltage bus 34, accessory bus 60, and ignition bus 62 is energized. ACCESSORY position 116 may correspond to a condition where engine 12 is not running, high voltage bus 34 is energized, accessory bus 60 is energized, and ignition bus 62 is not energized. Both ON/RUN position 118 and START position 120 may correspond to a condition where each of high voltage bus 34, accessory bus 60, and ignition bus 62 is energized.

Controller 100 may selectively energize accessory bus 60 and ignition bus 62 by controlling the states of an accessory relay 122 and an ignition relay 124, respectively. As shown in FIG. 2, accessory relay 122 may be disposed in low voltage bus 32 such that when accessory relay 122 is off, the voltage supplied by low voltage battery 20 is not passed to accessory bus 60. Conversely, when accessory relay 122 is on, the voltage supplied by low voltage battery 20 is passed to accessory bus 60. The operation of ignition relay 124 is similar to that of accessory relay 122.

In response to mode selector 112 being placed in ACCESSORY position 116, controller 100 may turn on accessory relay 122, thereby energizing accessory bus 60. In ACCESSORY position 116, controller 100 may maintain ignition relay 124 in an off state such that ignition bus 62 remains non-energized. In response to mode selector 112 being placed in ON/RUN position 118, controller 100 may turn on ignition relay 124, thereby energizing ignition bus 62. Ignition bus 62 may remain energized until controller 100 turns off ignition relay 124 in response to mode selector 112 being placed back into ACCESSORY position 116. Further, accessory bus 60 may remain energized until controller 100 turns off accessory relay 122 in response to mode selector 112 being placed back into OFF position 114.

Controller 100 may also be configured to minimize or prevent an overcurrent condition on high voltage bus 34. For example, if a high voltage source such as high voltage battery 22 makes contact with an electrical bus in a non-energized state, a current having a maximum magnitude of several thousand amps may flow to the electrical bus during the process of energizing the bus. While the maximum current may be present on the bus for only a very short period of time, such a large current may cause significant damage to various components in communication with the bus.

Controller 100 may operate in cooperation with other components of electrical system 18 to reduce the magnitude of the energizing current flowing to high voltage bus 34 from, for example, high voltage battery 22. Specifically, controller 100 may be configured to control the operation of switches 38 and 43 during an energizing sequence. Prior to energizing high voltage bus 34, controller 100 may first ensure that switch 43 is in an open position. Next, controller 100 may close switch 38 to place high voltage bus 34 in electrical communication with high voltage battery 22. Because switch 43 is open, however, the voltage potential of battery 22 will experience a high resistance path through resistor 41. Resistor 41 may limit the magnitude of the current flowing onto high voltage bus 34 according to the magnitude of the resistance provided by resistor 41. Once high voltage bus has been energized, switch 43 may be closed, thereby bypassing resistor 41. Depending on the requirements of a particular application, controller 100 may close switch 43 once high voltage bus 34 has been partially energized, fully energized, or even after a predetermined time delay.

Controller. 100 may control a discharge switch 44 that provides a path for discharging high voltage bus 34. Particularly, when all power sources have been placed in a state such that none of the power sources is providing power to high voltage bus 34, controller 100 can close switch 44, which allows discharge of high voltage bus 34 through resistor 42 to ground.

Controller 100 may also control the operation of up converter 36 to soft charge (i.e., limit the energizing current) high voltage bus 34. Prior to connecting high voltage battery 22, or another source of a high voltage potential, to high voltage bus 34, controller 100 may enable up converter 36 to allow current to flow from, for example, accessory bus 60 to energize high voltage bus 34. Particularly, up converter 36 may boost the voltage on accessory bus 60 to a level compatible with high voltage bus 34 and may limit the magnitude of the energizing current flowing from accessory bus 60 to high voltage bus 34.

INDUSTRIAL APPLICABILITY

Figure 3:
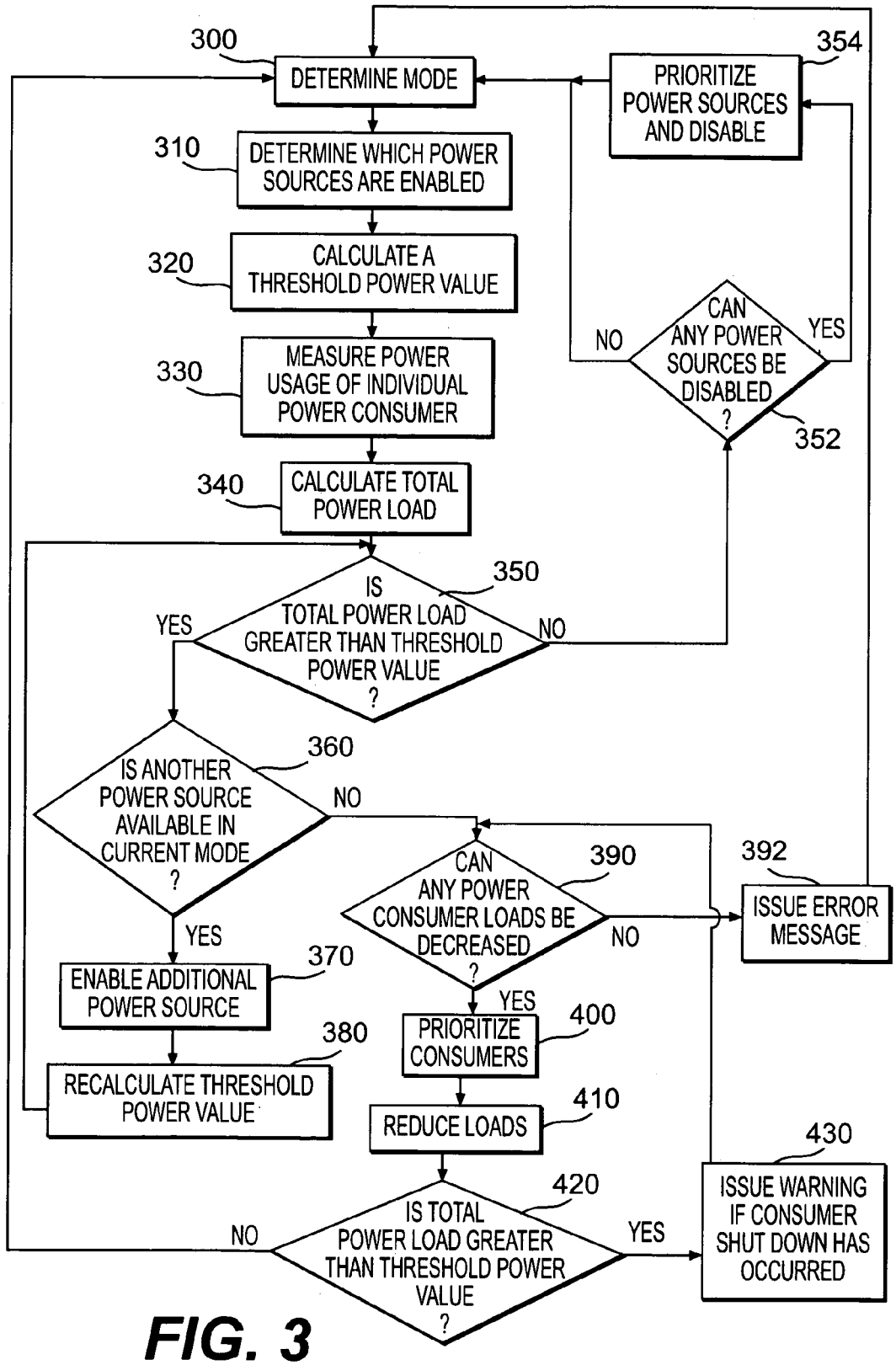
FIG. 3 provides a flowchart representative of a power management scheme according to an exemplary embodiment of the present invention.

FIG. 3 includes a flowchart representing an exemplary power management method for use with electrical system 18. The illustrated power management method may be automatically performed by one or more controller devices enabled to determine the mode of operation of electrical system 18 and to recognize which power sources are available to electrical system 18 for a particular mode of operation. Additionally, the one or more controller devices may monitor the power usage of the power consuming devices associated with electrical system 18. Further, the one or more controller devices may adjust, decrease, and/or limit the amount of power consumed by a particular power consuming device. Controller 100, for example, may include a processor for performing the steps illustrated in FIG. 3. Further, controller. 100 may include one or more storage devices (e.g., a memory) that include one or more software routines for performing the steps shown in FIG. 3.

Turning to FIG. 3, the mode of operation of electrical system 18 may be determined at step 300. For example, controller. 100 may determine the position of mode selector 112. The mode of operation, as discussed above, may be one of an OFF (114), ACCESSORY (116), ON/RUN (118), or START (120) state.

At step 310, the enabled power sources may be determined. That is, controller 100 may determine which power sources in communication with electrical system 18 are currently providing power to electrical system 18. Each of APU 28, shore power interface 30, and starter generator 24 may include associated control electronics (e.g., elements 52, 54, and 78, respectively) that may offer the capacity for determining whether current is being supplied to electrical system 18 from one or more of APU 28, shore power interface 30, and starter generator 24. A determination of whether or not low voltage battery 20 and high voltage battery 22 are enabled may be made by monitoring the voltage level present on high voltage bus 34, accessory bus 60, and/or ignition bus 62.

At step 320, a threshold power value may be calculated by controller 100, for example. The threshold power value may be associated with the group of power sources determined to be enabled in step 310. In one embodiment, the threshold power level may correspond to a maximum rated power output value for all of the enabled power sources taken together. The threshold power value, however, may be calculated based on any arbitrarily chosen criteria. For example, the threshold power value may be some fixed or variable fraction of the maximum rated power output and may depend on a particular set of operating conditions. Alternatively, the threshold power value may be associated with the power level capacity of components of electrical system 18 other than, or in addition to, the enabled power sources. For example, the threshold power value may be determined fully or partially on criteria associated with the current carrying capacity of various components of electrical system 18 or any other attributes of electrical system 18.

At step 330, the amount of power being consumed by one or more electrically powered accessories (i.e., power consumers) associated with electrical system 18 may be measured. It should be noted that this power usage measurement may include all power consumers connected to electrical system 18 or any subset of these power consumers. For example, the power usage measurement may be performed with respect to one or more arbitrarily chosen power consumers. At step 340, a total power load value may be calculated by summing together the power usage values obtained in step 330.

At step 350, the total power load value may be compared to the threshold power value. A total power load value less than the threshold power value may indicate that electrical system 18 is operating within a desired range. In this situation, an optional step 352 may be performed to determine whether any of the power sources may be disabled. Disabling one or more power sources in step 352 may have the effect of reducing the power consumption of electrical system 18, thereby potentially increasing operating efficiency. The one or more power sources, however, may only be disabled if doing so would not cause the total power load value to be greater than the threshold power value.

If controller 100, for example, determines that one or more power sources may be disabled without reducing the threshold power value below the total power load value, then the enabled power sources may be ranked according to priority in step 354. The priority determination may be made based on a pre-stored set.of values associated with each of the power sources in communication with electrical system 18. After prioritizing, the lowest priority power source may be disabled first. If a determination is made that additional power sources may be disabled, then the disabling process may continue by disabling the next lowest priority power source, and so on.

If, at step 350, controller 100 determines that the total power load is greater than a threshold power value, which may correspond to a situation where electrical system 18 is operating outside of a desired range, then controller 100 may determine, at step 360, whether or not any additional power sources are available in the currently selected mode. Such a determination may be made, for example, based on sensor input values (e.g., voltage sensors, contact sensors, engine operating sensors, etc.) that indicate the presence of non-enable power sources.

If controller 100 determines that another power source is available (i.e., connected to electrical system 18, compatible for operation in the currently selected mode, and not already enabled), then controller 100 may automatically enable one or more additional power sources at step 370. In response to enabling an additional power source, the threshold power value may be recalculated based on the newly enabled power source at step 380. The process then returns to step 350 to repeat the step of determining whether the total power load is greater than the threshold power value and subsequent steps.

If, at step 360, controller 100 determines that no other power sources may be enabled, then controller 100, at step 390, may attempt to determine whether any of the consumer power loads may be decreased. If none can be decreased, then controller 100 may issue an error message at step 392. The error message may indicate that the total power load has exceeded a desired operating range and that there are no additional resources currently available for increasing the power supplying capacity of electrical system 18. In such a condition, high voltage 22 may provide additional power to meet the total power load, but the power from high voltage battery 22 cannot be sustained indefinitely without discharging high voltage battery 22. If the condition persists, a user may manually alter the operation of electrical system 18 by shutting down one or more power consumers, in response to the warning message, for example. Alternatively, controller 100 may attempt to impose a mandatory brown-out or black-out condition in which the voltage levels on one or more areas of high voltage bus 34 and/or low voltage bus 32 is uniformly reduced.

At step 390, if controller 100 determines that the power loads of one or more power consumers may be decreased, then controller 100 may prioritize the one or more power consumers at step 400. For example, each power consumer may be assigned a priority rank according to a pre-determined importance factor associated with each power consumer. Certain power consumers, which may be critical to the safe operation of, for example, engine 12 (e.g., oil pump 82 and water pump 84), may be assigned a designation indicating that these consumers are unavailable for potential power load reduction. Other power consumers (e.g., HVAC unit 26 and power outlets 76) may be candidates for power load reduction. If, for example, HVAC unit 26 is assigned a lower priority rank than power outlets 76, then the power load of HVAC unit 26 may be reduced at step 410.

To accomplish the power load reduction of a power consumer at step 410, controller 100 may communicate a load reduction signal to control electronics associated with the power consumer. Alternatively, controller 100 may issue a direct speed control command to the power consumer that directly controls the operating speed, and therefore, the power load of the power consumer. For example, if HVAC unit 26 is designated the lowest priority power consumer, then controller 100 may issue a signal to, for example, compressor converter 92 that causes a reduction in the operating speed of HVAC compressor 94. The amount of reduction for a particular power consumer is arbitrary and may correspond to pre-stored values associated with each of the power consumers.

At step 420, the effect of the power load reduction of step 410 is determined. If the total power load is no longer greater than the threshold power value, then electrical system 18 is, once again, operating within a desired operating range, and the process returns to step 300. If, however, the total power load is still greater than the threshold power value, then the process returns to step 390. That is, controller 100 will again prioritize the power consumers and attempt a power level reduction of the lowest priority power consumer. Controller 100 may be configured such that previous reductions in power load for a particular power consumer may have the effect of raising the priority rank for that device. In this way, the power reductions may be spread out over all of the power consumers available for power load reductions. A situation may arise, however, where one power consumer consistently ranks as the lowest priority consumer. In this case, all power load adjustments may be made to this consumer until the consumer is completely shut down. If after a power load reduction at step 420, controller 100 determines that the power load adjustment has resulted in the complete shut down of one or more power consumers, then a warning message may be issued at step 430.

The disclosed electrical system 18 and associated power management system may be included in any vehicle where it would be desirable to operate one or more electrical accessories. Electrical system 18 may offer the ability to electrically drive certain components on a vehicle that, in traditional systems, were powered by the vehicle engine. For example, electrical system 18 may provide power to and operate devices such as an HVAC unit, an oil pump, a water pump, an air compressor, electrical outlets for powering one or more electronic devices, and various other components.

Operating such electrical accessories using electrical power rather than power supplied by a vehicle engine may offer several advantages. Specifically, the fuel efficiency of a vehicle may be improved. Rather than idling a truck or work machine for extended periods of time in order to provide power to an air conditioning unit, power outlets, lights, and other components, the engine may be shut down, and the components may be operated using electrical power supplied by one or more of the power sources in communication with electrical system 18. Further, the engine life of a vehicle may be extended as a result of a reduced need for extended idling.

The combination of power sources of electrical system 18 may also provide a operational flexibility. Rather than a configuration including only a low voltage battery and a high voltage battery, which may be unable to meet the power needs of vehicle 10 over long periods of time without using operating engine 12 to charge the batteries, APU 28, starter generator 24, and shore power interface 30 may be used to supplement the power needs of the devices supplied by electrical system 18. While starter generator 24 may provide power to electrical system 18 when engine 12 is running, APU 28 and/or shore power interface 30 may provide power to electrical system 18 when engine 12 is either running or not running. Further, high voltage battery 22 may provide continuity to electrical system 18 by supplying power during times when engine 12 is not running and APU 28 and shore power interface 30 are not available for supplying power.

The DC voltage potential carried by high voltage bus 34 may offer several advantages. Particularly, at levels of at least about 50 V, sufficient power is available for operating even high load electrical devices. Also, electric motors associated with the devices ultimately driven by the DC voltage may be operated at any desired speed. For example, one or more power converting devices may be. configured to receive the DC voltage of high voltage bus 34 and generate a local, time-varying motor drive signal. This local drive signal may have any arbitrary frequency, which may itself be constant or varied over time. This arrangement differs from traditional systems driven from global AC voltage sources. In those systems, the electric motor drive speeds are confined to the particular frequency of the AC source. Further, by providing the ability to generate local drive signals, any or all of the electric motors ultimately driven from the voltage of high voltage bus 34 may be operated at different frequencies.

As an added benefit of electrical system 18, the various electrical accessories that receive power from electrical system 18 may be isolated from the operation of engine 12. Unlike traditional oil pumps, water pumps, etc., which were run at speeds tied to the speed of engine 12, electrical system 18 enables operation of the various components at any desired speed different from the speed of engine 12. This feature may allow the operational characteristics of a particular electrical accessory to be tailored to meet the specific requirements of a particular application. The electrical components may be designed to meet a specific operating capacity, which may reduce the cost of the components. For example, because the operating speeds of the electrical components in electrical system 18 are not tied to the speed of engine 12, these components do not need to be overdesigned to account for situations where engine 12 is running but producing insufficient speeds to meet the needs of various systems associated with the electrical components.

Another beneficial feature of electrical system 18 is the partitioned bus. Partitioning low voltage bus 32, for example, into accessory bus 60 and ignition bus 62 may enable partial operation of low voltage bus 32, which can increase the efficiency of vehicle 10 by decreasing unnecessary power consumption. As discussed above, ignition bus 62 and accessory bus 60 may operate independently. In an ACCESSORY mode, only those accessories associated with accessory bus 60 (e.g., accessories unrelated to the operation of engine 12) may receive power. In a RUN/START mode, however, ignition bus 62 may be energized in addition to accessory bus 60 to power electrical components associated with the operation of engine 12. In this manner, the electrical components associated with engine 12 are not unnecessarily powered during times when engine 12 is not operating.

It will be apparent to those skilled in the art that various modifications and variations can be made in the disclosed electrical system and power management system without departing from the scope of the disclosure. Additionally, other embodiments of the electrical system and power management system will be apparent to those skilled in the art from consideration of the specification. It is intended that the specification and examples be considered as exemplary only, with a true scope of the disclosure being indicated by the following claims and their equivalents.

What is claimed is:

1. A method of managing power resources for an electrical system of a vehicle, comprising:

identifying enabled power sources from among a plurality of power sources in electrical communication with the electrical system;

calculating a threshold power value for the enabled power sources;

measuring a total power load placed on the electrical system by one or more power consumers;

determining, if the total power load exceeds the threshold power value, whether one or more additional power sources is available from among the plurality of power sources; and automatically enabling at least one of the one or more additional power sources, if available.

2. The method of claim 1, further including:

determining, if the total power load does not exceed the threshold power value, whether any of the enabled power sources may be disabled; and disabling one or more of the enabled power sources.

3. The method of claim 1, wherein the measuring step further includes measuring a power load value placed on the electrical system by each of the one or more power consumers and calculating the total power load by summing each of the power loads of the one or more power consumers.

4. The method of claim 1, wherein the plurality of power sources includes a low voltage battery, a high voltage battery, and a starter generator.

5. The method of claim 1, wherein the plurality of power sources includes a low voltage battery, a high voltage battery, a starter generator, an auxiliary power unit, and a shore power interface.

6. The method of claim 1, further including:

determining an operating mode of the electrical system;

and basing the determination of whether one or more additional power sources is available at least partially on the operating mode.

7. The method of claim 6, wherein the determining an operating mode step includes determining the position of a key switch of the vehicle.

8. A method of managing power resources for an electrical system of a vehicle, comprising:

identifying enabled power sources from among a plurality of power sources in electrical communication with the electrical system;

calculating a threshold power value for the enabled power sources;

measuring a total power load placed on the electrical system by one or more power consumers; and decreasing a power load value for at least one of the one or more power consumers if the total power load exceeds the threshold power value.

9. The method of claim 8, wherein the plurality of power sources includes a low voltage battery, a high voltage battery, a starter generator, an auxiliary power unit, and a shore power interface.

10. The method of claim 8, further including:

assigning a priority rank to each of the one or more power consumers; and identifying a low priority consumer from among the one or more power consumers based on which of the one or more power consumers has the lowest priority rank.

11. The method of claim 10, wherein the decreasing a power load value step is performed on the low priority consumer.

12. A method of managing power resources for an electrical system of a vehicle, comprising:

identifying enabled power sources from among a plurality of power sources in electrical communication with the electrical system;

calculating a threshold power value for the enabled power sources;

measuring a total power load placed on the electrical system by one or more power consumers;

determining whether a power load value of any of the one or more power consumers may be decreased;

assigning a priority rank value to each of the one or more power consumers if at least one power load value of the one or more power consumers may be decreased;

identifying a low priority consumer according to which of the one or more power consumers has the lowest priority rank; and decreasing a power load value of the low priority consumer.

13. The method of claim 12, further including:

decreasing a power load value for one or more power consumers having a priority rank higher than the low priority consumer.

14. The method of claim 12, further including:

repeating the determining, assigning, identifying the low priority consumer, and decreasing steps until the total power load is less than the threshold power value.

15. The method of claim 12, further including:

repeating the determining, assigning, identifying the low priority consumer, and decreasing steps until no further reductions in power load values of the one or more power consumers are allowable.

16. The method of claim 15, further including:

issuing an error signal.

17. The method of claim 12, wherein the plurality of power sources includes a low voltage battery, a high voltage battery, a starter generator, an auxiliary power unit, and a shore power interface.

18. A controller for an electrical system of a vehicle, comprising:

at least one processor;

a storage device including one or more instructions for performing the steps of:

identifying enabled power sources from among a plurality of power sources in electrical communication with the electrical system;

calculating a threshold power value for the enabled power sources; and measuring a total power load placed on the electrical system by one or more power consumers;

wherein the one or more instructions are further configured to perform at least one of the steps of:

decreasing a power load value for at least one of the one or more power consumers if the total power load exceeds the threshold power value, and enabling at least one additional power source from among the plurality of power sources.

19. The controller of claim 18, wherein the plurality of power sources includes a low voltage battery, a high voltage battery, a starter generator, an auxiliary power unit, and a shore power interface.

20. A vehicle including the controller of claim 18.

* * * * *